United States Patent [19]

Fricker

[11] Patent Number: 4,867,428

[45] Date of Patent: Sep. 19, 1989

[54] DEVICE FOR CLAMPING FIREPROOF PLATES IN METAL FRAMES OF SLIDE-VALVE SHUTTERS

[75] Inventor: Robert Fricker, Unterägeri, Switzerland

[73] Assignee: Stopinc Aktiengesellschaft, Baar, Switzerland

[21] Appl. No.: 199,408

[22] PCT Filed: Jul. 28, 1987

[86] PCT No.: PCT/EP87/00404

§ 371 Date: Mar. 3, 1988

§ 102(e) Date: Mar. 3, 1988

[87] PCT Pub. No.: WO88/03069

PCT Pub. Date: May 5, 1988

[30] Foreign Application Priority Data

Oct. 21, 1986 [DE] Fed. Rep. of Germany ..... 3635717

[51] Int. Cl.[4] ..... B23Q 3/02

[52] U.S. Cl. ..... 269/134; 269/138; 269/234; 222/591

[58] Field of Search ..... 269/138, 137, 217, 234, 269/247, 134; 254/104; 164/337, 437; 222/591; 266/195, 236

[56] References Cited

U.S. PATENT DOCUMENTS

| | | | |
|---|---|---|---|
| 2,600,183 | 6/1952 | Arnold | 254/104 |
| 2,637,249 | 9/5195 | Swenson | 269/134 |
| 2,667,799 | 2/1954 | Rzepela . | |

FOREIGN PATENT DOCUMENTS

| | | |
|---|---|---|
| 3522134 | 1/1986 | Fed. Rep. of Germany . |
| 61-159259 | 7/1986 | Japan . |

*Primary Examiner*—Frederick R. Schmidt
*Assistant Examiner*—David A. Holmes
*Attorney, Agent, or Firm*—Wenderoth, Lind & Ponack

[57] ABSTRACT

A clamping device for clamping a fireproof plate into a metal frame of slide gate includes a clamping jaw that can be pressed against the plate perimeter. A wedge-shaped member acts on the clamping jaw and is threaded onto a bolt that is rotatably positioned in the frame. The clamping jaw and the wedge-shaped member have engaging slots and keys that cause positive withdrawal of the clamping jaw upon loosening the wedge-shaped member.

22 Claims, 2 Drawing Sheets

Fig.4
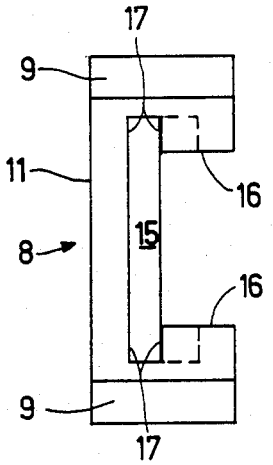
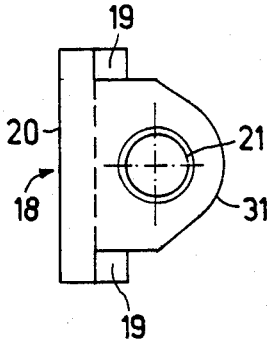
Fig.6
Fig.5
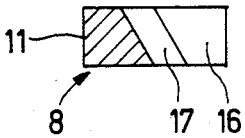
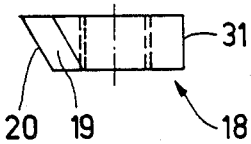
Fig.7

DEVICE FOR CLAMPING FIREPROOF PLATES IN METAL FRAMES OF SLIDE-VALVE SHUTTERS

BACKGROUND OF THE INVENTION

The present invention relates to a device for clamping a refractory fireproof plate into a metal frame of a slide gate or sliding closure unit for controlling the discharge of molten metal from a metallurgical vessel. More particularly, the invention relates to such a device including a wedge-shaped member that has a drive surface that exerts a wedging effect in a direction transverse to the circumference of the plate by displacement of a bolt positioned in the frame.

Clamping devices with wedge-shaped members are known from DE-OS NO. 35 22 134, wherein such members engage between the periphery of the fireproof plate and a peripheral area of the metallic frame when bolts that are inserted through holes in the wedge-shaped member and screwed into tapholes in the frame are tightened. The disadvantage to this arrangement is that in loosening the bolts, in order to change plates for example, the wedge-shaped members often stick to the plates as a result of thermal distortion and fouling and can be dislodged only with great difficulty, which hinders efficient replacement of the plates.

SUMMARY OF THE INVENTION

The object of the present invention is to improve the performance of such a clamping device, especially when loosening the grip thereof to replace a plate.

According to the invention, this object is achieved in that the wedge-shaped member is movable along the thread of a turnable bolt rotatably mounted in the frame upon rotation of the bolt, and that the drive surface of the wedge-shaped member acts on a pressure surface of a clamp jaw that slides in the frame and that is engaged with the wedge-shaped member via tracks that are inclined parallel to the drive surface. This means not only that when the bolt is tightened the clamp jaw transmits a uniformly clamped surface pressure to the plate perimeter area, which is at any rate perpendicular to the plate surface, but that when the bolt is untightened, the loosening of the wedge-shaped member results in positive retraction of the clamp jaw from the plate perimeter. Because of this, the fireproof plate is automatically exposed in the frame for an unimpeded, rapid plate replacement operation.

In terms of design of the device, it is appropriate that the clamp jaw slides in a bed of the frame and spans the wedge-shaped member that is movable along the bolt, and that the member has a U-shape with side walls extending in the slide direction and having contact surfaces in which are formed the tracks. Advantageously the tracks are configured as slots formed in the side walls and joining the pressure surface of the clamping jaw. The slots receive correspondingly shaped keys of the wedge-shaped member. This construction is simple and effective.

In terms of the configuration, positioning and manipulation of the bolt supporting the wedge-shaped member, the invention provides that the bolt be positioned perpendicular or nearly perpendicular to the planar surface of the plate, with a collar at one end of the bolt positioned in a stepped recess of the frame, and with the bolt having a socket wrench profile at an opposite end.

This results in a compact design of the device, which is braced against and fully integrated in the frame.

BRIEF DESCRIPTION OF THE DRAWINGS

The invention is described in more detail below with reference to the drawings, wherein:

FIG. 4 is a plan view of an element shown in FIG. 3;

FIG. 5 is a cross-section through the element of FIG. 4;

FIG. 6 is a plan view of another element shown in FIG. 3; and

FIG. 7 is a side view of the element of FIG. 6.

DETAILED DESCRIPTION OF THE INVENTION

Figure 1:
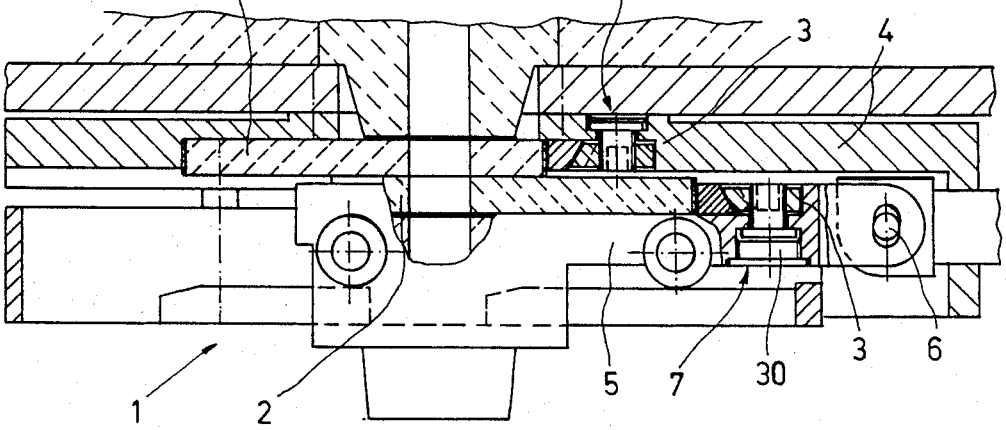
FIG. 1 is a longitudinal section of a linearly movable sliding closure unit equipped with clamping devices according to the invention.
Figure 2:
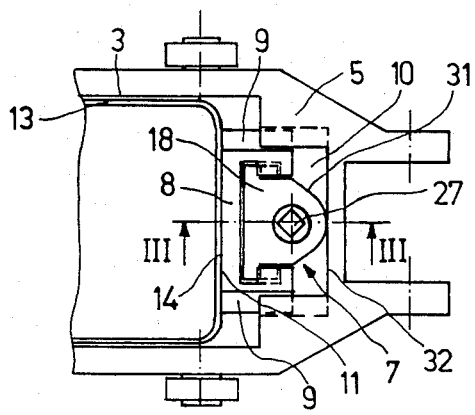
FIG. 2 is a partial plan view of the movable plate and the frame thereof of the unit of FIG. 1, shown with a clamping device of the invention.

A slide gate or sliding closure unit 1 shown in FIG. 1 is not described in detail and includes two fireproof refractory plates 2, i.e. a stationary plate and a movable slide plate. Both plates are held in respective recesses in metal frames 3, i.e. the stationary plate in a stationary frame 4 and the slide plate in a movable frame 5 which can be swung downwardly away from frame 4 from the illustrated operating position around an axis 6 to an open position. In this position of the valve frame 5, which is not illustrated in FIG. 1 for the sake of clarity, identical clamping devices 7, with which the plates 2 are clamped in their frames 3 in order to avoid relative movements between the plates 2 and the frames 3 when moving the frame 5, are accessible to an operator for replacing the plates. A further device can be employed in the case of a three-plate slide gate.

Each device 7 includes a U-shaped clamping jaw 8, which is held in a sliding bed 10 of the frame 3 and has border strips 9 provided on the legs of the U-shape. The external side of the web connecting the legs of the U-shape defines a contact surface 11 for abutting the perimeter 14 of the plate, by way of a metal sheath or ring 13 mounted therearound. The inside of the web of the U-shape has a pressure surface 15 obliquely inclined to the plate perimeter 14, the ends of which are extended into slots 17 formed in the inner surfaces 16 of the legs of the U-shape, slots 17 and surface 15 having the same inclination (FIGS. 4 and 5).

The U-shaped clamping jaw 8 receives a wedge-shaped member 18 that has lateral keys 19 engaging in the slots 17 and a drive surface 20 complementary to and engaging the pressure surface 15. Alternatively, at least one key could be formed on configured clamping jaw 8 to engage in a correspondingly configured slot formed in the wedge-shaped member 18.

The wedge-shaped member 18 has therethrough a tapped hole 21 extending vertically to the plane of plate 2 and frame 3. Adjustably threaded into hole 21 is a bolt 23 that is rotatable about its longitudinal axis and that extends into a recessed hole 22 in the frame 3. Bolt 23 has a collar 24 abutting against a surface 25 of a recess 29 of the hole 22 and also has at the opposite end 26 thereof a profile 27 for introduction of a socket wrench 28. The expanded recess 29 of the hole 22 enables insertion of the bolt 23 and can be closed by a plug 30. In addition, a rounded perimeter area 31 of the wedge-shaped member 18, which is not encompassed by the clamping jaw 8, abuts with and slides on a transverse wall 32 which defines the sliding bed 10 in the frame 3.

Figure 3:
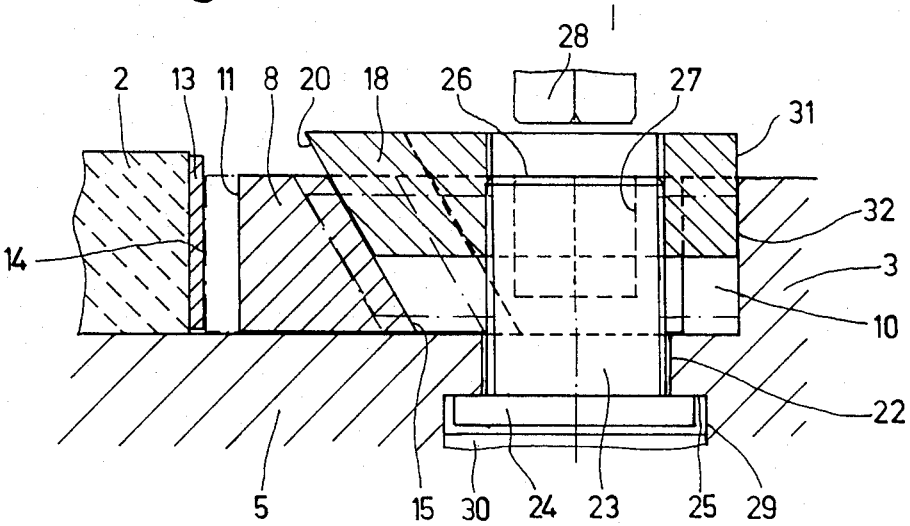
FIG. 3 is a section along line III—III in FIG. 2, on an enlarged scale.

As FIG. 3 in particular shows, when the wrench 28 is used to tighten the plate 2 in the frame 3, the wedge-shaped member 18 moves further onto the bolt 23 and moves the clamping jaw 8, by applying pressure by way of the drive surface 20 against the pressure surface 15, in the sliding bed 10 in the direction of the plate perimeter 14, until the plate is clamped within the frame. In contrast, when the clamping device is loosened by the withdrawal of the wedge-shaped member 18 from the bolt 23, the keys 19 sliding in the tracks 17 positively pull the clamping jaw 8 away from the plate perimeter 14, thus releasing the plate 2 for replacement or repair thereof.

It is inherent to the present invention that the device 7 can be used in other peripheral areas of the plate 2 than the front or end are illustrated. Moreover, several devices 7 can be distributed around the plate perimeter 14, which in concurrence with the contact surface 11 of the clamping jaw 8 can also have other shapes, e.g. an oval or a round shape.

In addition, the bolt can, instead of being perpendicular, just as easily be parallel to the plate surfaces and to its perimeter in the frame 3. In such case, the drive and pressure surfaces would have to be oblique in a horizontal direction, and a pulling key at the drive surface would engage with a slot in the clamping jaw.

I claim:

1. A clamping device for use in clamping a fireproof refractory plate into a metal frame of a sliding closure unit used for controlling the discharge of molten metal from a metallurgical vessel, said clamping device comprising:

a clamping jaw to be mounted in a metal frame for sliding movement in opposite first and second rectilinear directions respectively toward and away from the periphery of a fireproof refractory plate, said clamping jaw having a pressure surface inclined to said directions;

a wedge-shaped member having a drive surface abutting said pressure surface of said clamping jaw;

bolt means, in threaded engagement with said wedge-shaped member and to be mounted in the metal frame for free rotation relative thereto about the longitudinal axis of said bolt means, for upon rotation of said bolt means in a first direction about said axis, moving said wedge-shaped member in a first direction axially of said bolt means such that said drive surface of said wedge-shaped member acts on said pressure surface of said clamping jaw to move said clamping jaw in said first rectilinear direction to clamp the periphery of the fireproof refractory plate, and for, upon rotation of said bolt means in a second direction about said axis, moving said wedge-shaped member in a second direction axially of said bolt means; and said clamping jaw and said wedge-shaped member having cooperating means for, upon said wedge-shaped member being moved in said second direction axially of said bolt means, causing said clamping jaw to move in said second rectilinear direction away from the periphery of the fireproof refractory plate.

2. A device as claimed in claim 1, wherein said cooperating means comprises at least one recess formed in one of said clamping jaw or said wedge-shaped member and at least one projection complementary to said recess and extending from the other of said clamping jaw or said wedge-shaped member into said recess.

3. A device as claimed in claim 2, wherein said projection and said recess are inclined by the same inclination as said pressure surface.

4. A device as claimed in claim 1, wherein said drive surface is complementary to said pressure surface.

5. A device as claimed in claim 1, wherein said clamping jaw has a U-shaped configuration including spaced side walls positioned on opposite sides of said wedge-shaped member and extending in said rectilinear directions and a web portion connecting said side walls.

6. A device as claimed in claim 5, wherein said pressure surface is formed on said web portion, and said cooperating means of said clamping jaw are located at said side walls.

7. A device as claimed in claim 6, wherein said cooperating means comprise recesses formed in said side walls and projections extending from said wedge-shaped member into respective of said recesses.

8. A device as claimed in claim 7, wherein said projections and said recesses are inclined by the same inclination as said pressure surface.

9. A device as claimed in claim 8, wherein said pressure surface is extended laterally into said side walls to define surfaces of said recesses.

10. A device as claimed in claim 1, wherein said bolt means is threaded through said wedge-shaped member and extends substantially perpendicular to said directions and of a planar surface of the plate.

11. A device as claimed in claim 10, wherein said bolt means has at a first end thereof a widened collar to fit within a recess in the metal frame and at a second end thereof a tool engaging configuration.

12. In an assembly for use in a sliding closure unit for controlling the discharge of molten metal from a metallurgical vessel, said assembly comprising a metal frame, a fireproof refractory plate mounted within said metal frame, and a clamping device for clamping said plate within said frame, the improvement wherein said clamping device comprises:

a clamping jaw mounted in said metal frame for sliding movement in opposite first and second rectilinear directions respectively toward and away from the periphery of said fireproof refractory plate, said clamping jaw having a pressure surface inclined to said directions;

a wedge-shaped member having a drive surface abutting said pressure surface of said clamping jaw;

bolt means, in threaded engagement with said wedge-shaped member and mounted in said metal frame for free rotation relative thereto about the longitudinal axis of said bolt means, for, upon rotation of said bolt means in a first direction about said axis, moving said wedge-shaped member in a first direction axially of said bolt means such that said drive surface of said wedge-shaped member acts on said pressure surface of said clamping jaw to move said clamping jaw in said first rectilinear direction to clamp said periphery of said fireproof refractory plate, and for, upon rotation of said bolt means in a second direction about said axis, moving said wedge-shaped member in a second direction axially of said bolt means; and said clamping jaw and said wedge-shaped member having cooperating means for, upon said wedge-shaped member being moved in said second direction axially of said bolt means, causing said clamping jaw to move in said second rectilinear direction away from said periphery of said fireproof refractory plate.

13. The improvement claimed in claim 12, wherein said cooperating means comprises at least one recess formed in one of said clamping jaw or said wedge-shaped member and at least one projection complementary to said recess and extending from the other of said clamping jaw or said wedge-shaped member into said recess.

14. The improvement claimed in claim 13, wherein said projection and said recess are inclined by the same inclination as said pressure surface.

15. The improvement claimed in claim 12, wherein said drive surface is complementary to said pressure surface.

16. The improvement claimed in claim 12, wherein said clamping jaw has a U-shaped configuration including spaced side walls positioned on opposite sides of said wedge-shaped member and extending in said rectilinear directions and a web portion connecting said side walls.

17. The improvement claimed in claim 16, wherein said pressure surface is formed on said web portion, and said cooperating means of said clamping jaw are located at said side walls.

18. The improvement claimed in claim 17, wherein said cooperating means comprise recesses formed in said side walls and projections extending from said wedge-shaped member into respective of said recesses.

19. The improvement claimed in claim 18, wherein said projections and said recesses are inclined by the same inclination as said pressure surface.

20. The improvement claimed in claim 19, wherein said pressure surface is extended laterally into said side walls to define surfaces of said recesses.

21. The improvement claimed in claim 12, wherein said bolt means is threaded through said wedge-shaped member and extends substantially perpendicular to said directions and of a planar surface of said plate.

22. The improvement claimed in claim 21, wherein said bolt means has a first end thereof a widened collar fitting within a recess in said metal frame and at a second end thereof a tool engaging configuration.

* * * * *